United States Patent [19]

Jauch et al.

[11] Patent Number: 4,606,317

[45] Date of Patent: Aug. 19, 1986

[54] FUEL INJECTION SYSTEM

[75] Inventors: Gerhard Jauch, Markgröningen; Ernst Lang, Gerlingen; Ulrich Leu, Stuttgart; Willi Strohl, Schwieberdingen, all of Fed. Rep. of Germany

[73] Assignee: Robert Bosch GmbH, Stuttgart, Fed. Rep. of Germany

[21] Appl. No.: 687,891

[22] Filed: Dec. 31, 1984

[30] Foreign Application Priority Data

Apr. 5, 1984 [DE] Fed. Rep. of Germany ..... 3412746

[51] Int. Cl.[4] ..... F02M 39/00

[52] U.S. Cl. ..... 123/452; 123/514; 123/453

[58] Field of Search ..... 123/452, 453, 454, 455, 123/514, 516

[56] References Cited

U.S. PATENT DOCUMENTS

| | | | |
|---|---|---|---|
| 4,341,192 | 7/1982 | Knapp | 123/452 |
| 4,346,687 | 8/1982 | Pauder | 123/516 |
| 4,359,990 | 11/1982 | Kromer | 123/453 |
| 4,381,751 | 5/1983 | Maisch | 123/454 |
| 4,530,329 | 7/1985 | Maisch | 123/458 |

FOREIGN PATENT DOCUMENTS

| | | | |
|---|---|---|---|
| 2758065 | 7/1979 | Fed. Rep. of Germany | 123/453 |

*Primary Examiner*—Carl Stuart Miller

*Attorney, Agent, or Firm*—Edwin E. Greigg

[57] ABSTRACT

A fuel injection system is proposed which serves to supply fuel to an internal combustion engine. The fuel injection system includes a metering and quantity distributing valve connected with regulating valves, which can be acted upon by the fuel pressure in a differential pressure control line. Communicating with a fuel supply line are a pressure limiting valve and a switch member, the latter having a switch diaphragm which is displaceable into a return flow chamber by the fuel pressure counter to a switch spring and a closing spring. Upon this displacement, via a tappet, a spring plate resting on the switch diaphragm opens a sealing valve, which rests at the mouth of an outflow line, which via a control throttle leads to the differential pressure control line. The pressure limiting valve is located upstream of the sealing valve. The return flow chamber is arranged to communicate with the fuel container via a return flow line.

2 Claims, 2 Drawing Figures

FUEL INJECTION SYSTEM

BACKGROUND OF THE INVENTION

The invention is based on a fuel injection system as disclosed hereinafter. A fuel injection system has already been proposed in which a diaphragm pressure limiting valve is provided, with which a sealing valve actuatable by a reservoir element is associated. Once the internal combustion engine is shut off, it is possible on the one hand to attain a pressure drop below the opening pressure of the fuel injection valves, while on the other hand the return flow lines of the fuel injection system are blocked, thereby avoiding a further fuel pressure drop over a relatively long period and the attendant formation of vapor bubbles in the fuel injection system and assuring problem-free starting of the engine. Because of the proposed actuation of the sealing valve by the reservoir element, an additional expenditure for adjustment and manufacture is involved.

OBJECT AND SUMMARY OF THE INVENTION

The fuel injection system according to the invention has the advantage over the prior art of simpler and less expensive manufacture, with greater functional reliability and a more compact structure.

By further means disclosed hereinafter an advantageous improvement of the fuel injection system is also attainable, because by this means a throttle can be devised in a simple manner.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
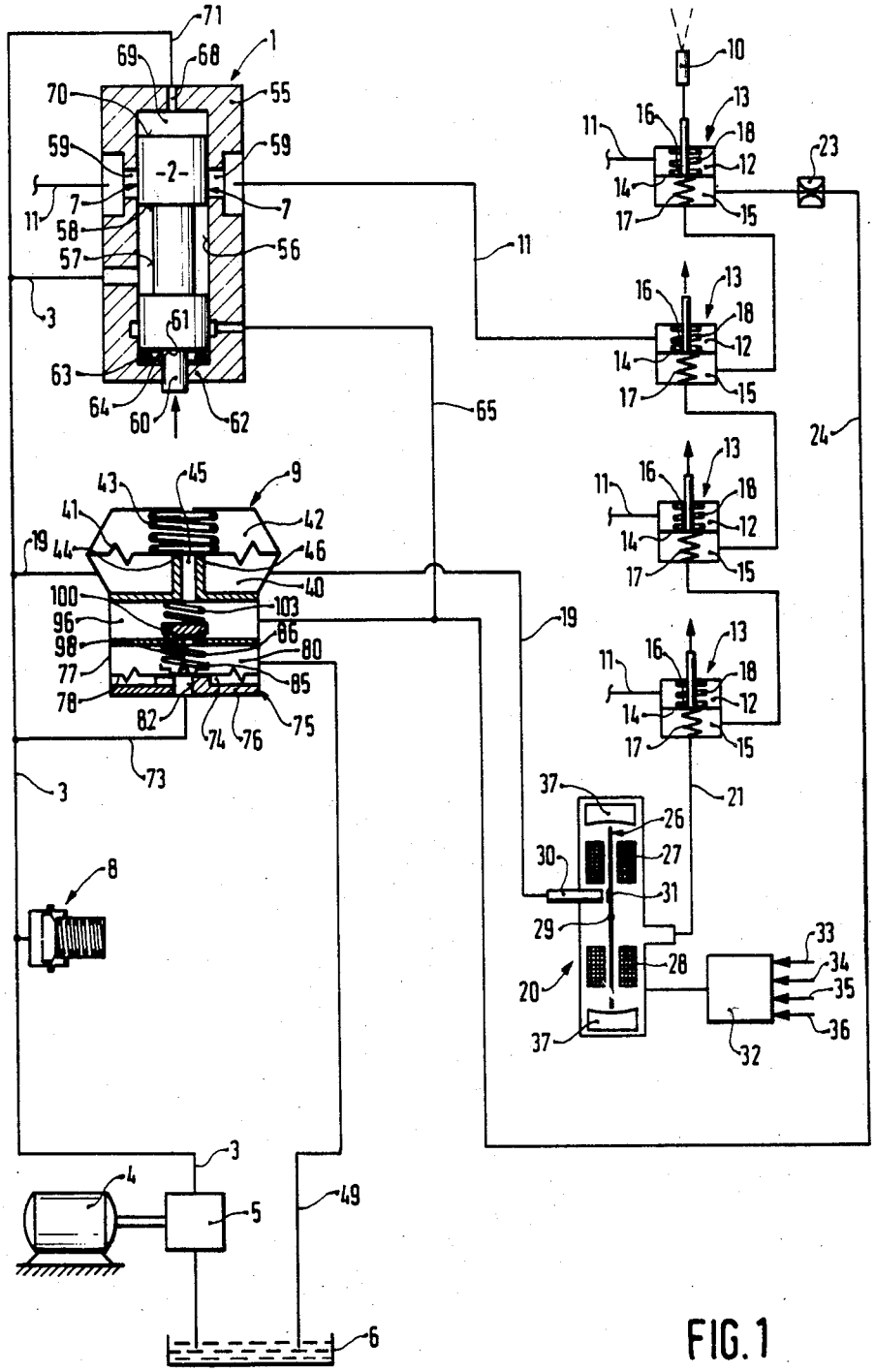
FIG. 1 schematically shows a fuel injection system embodied in accordance with the invention.

In FIG. 1 there is shown an exemplary embodiment of a fuel injection system which includes a metering and fuel quantity distributing valve 1. One metering valve 7 is associated with each cylinder of the mixture-compressing internal combustion engine (not shown) having externally supplied ignition. At the metering valve 7, a quantity of fuel is metered that is at a specific ratio to the quantity of air aspirated by the engine. The fuel injection system shown by way of example has four metering valves 7, of which two are shown, and is thus intended for a four-cylinder internal combustion engine. The cross section of the metering valves 7 is for instance variable in common by means of a control slide 2, which acts as a movable metering valve element, in accordance with engine operating characteristics, for instance in a known manner in accordance with the quantity of air aspirated by the engine. The metering valves 7 are located in a fuel supply line 3, into which fuel is pumped out of a fuel container 6 by a fuel pump 5 driven by an electric motor 4. A spring reservoir 8 is located along the fuel supply line 3, and in a known manner it is capable of slowly yielding fuel to the fuel supply line 3 after the shutoff of the engine. A line 19 branches off from the fuel supply line 3 to a pressure limiting valve 9, which limits the fuel pressure prevailing in the fuel supply line 3 and if the limit is exceeded causes fuel to flow back into the fuel container 6 via a return line 49.

Downstream of each metering valve 7, a line 11 is provided by way of which the metered fuel reaches a regulating chamber 12 of a separate regulating valve 13 associated with each metering valve 7. The regulating chamber 12 of the regulating valve 13 is divided from a control chamber 15 of the regulating valve 13 by means of a movable valve element, for instance embodied as a diaphragm 14. The diaphragm 14 of the regulating valve 13 cooperates with a fixed valve seat 16 provided in the regulating chamber 12; the metered fuel can flow via this fixed valve seat 16 out of the regulating chamber 12 to the various injection valves 10, only one of which is shown, in the intake tube of the engine. A differential pressure spring 18 may be disposed in the regulating chamber 12, urging the diaphragm 14 in the opening direction of the regulating valve 13. A closing spring 17 may likewise be disposed in the control chamber 15, its spring force being greater than that of the differential pressure spring 18, so that when the engine is shut off the diaphragm 14 is held at the valve seat 16 and will not execute any stroke movement toward the valve seat when the engine is started.

From the fuel supply line 3, the line 19 also leads to an electrofluidic converter of the nozzle/impact plate type 20 and discharges by way of this converter into a differential pressure control line 21. The control chambers 15 of each the regulating valves 13 are disposed downstream of the electrofluidic converter 20, and a control throttle 23 is disposed downstream of the control chambers 15. Via the control throttle 23, fuel can flow out of the differential pressure control line 21 into an outflow line 24. The electrofluidic converter 20 of the nozzle/impact plate type is known per se and will therefore be described only briefly herein in terms of its function and mode of operation. The electrofluidic converter 20 includes a rocker 26, which is subjected to a variable deflecting moment, for instance electromagnetically via coils 27, 28, so that it undergoes a certain deflection about an axis of rotation 29. The line 19 discharges at a nozzle 30 in the electrofluid converter 20 opposite an impact plate 31 attached to the rocker 26. At a constant deflecting moment engaging the rocker 26, a pressure drop between the nozzle 30 and the impact plate 31 is thus brought about, which is large enough that a constant pressure difference, dependent on the deflecting moment, is established between the fuel pressure in the line 19 and the fuel pressure in the differential pressure control line 21. The triggering of the electrofluidic converter 20 is effected via an electronic control unit 32 in accordance with appropriately supplied engine operating characteristics such as rpm 33, throttle valve position 34, temperature 35, exhaust gas composition (oxygen sensor) 36 and others. The triggering of the electrofluidic converter 20 by the electronic control unit 32 may be effected either in analog fashion or in a clocked manner. In the nonexcited state of the electrofluidic converter 20, a basic moment designed such as to establish a pressure difference sufficient to assure emergency operation of the engine even if the electrical triggering means should fail may be generated at the rocker 26 by suitable spring forces or permanent magnets 37.

In the presence of control signals characterizing engine overrunning, such as an rpm above idling rpm while the throttle valve is closed, the electrofluidic converter 20 can be excited in such a manner that the fuel pressure in the differential pressure control line 21 increases enough to close the regulating valves 13, thereby precluding fuel injection via the injection valves 10.

The differential pressure valve 9 has a system pressure chamber 40, which communicates with the fuel supply line 3 via the line 19 and is divided by a valve diaphragm 41 from a spring chamber 42, which in turn communicates with the atmosphere or with the engine intake tube and in which a system pressure spring 43 is disposed, which urges the valve diaphragm 41 in the closing direction of the valve. A valve seat 44 which cooperates with the valve diaphragm 41 protrudes into the system pressure chamber 40. Fuel flowing out via the valve seat 44 enters an outflow bore 45, which leads to a return flow line 49, and from there the fuel reaches the intake side of the fuel pump 5, flowing for instance to the fuel container 6. A relief throttle 46 bypassing the pressure limiting valve 9 is embodied in the form of a notch in the valve seat 44, leading from the system pressure chamber 40 to the outflow bore 45.

The metering and quantity distributing valve 1 has a metering sleeve 55, in which the control slide is supported such that it is axially displaceable in a slide bore 56. The control slide 2 has a control groove 57, which is defined on one side by a control edge 58. Upon a displacement movement upward, the control edge 58 opens a variable number of control openings 59, for instance control slits, by way of which fuel can flow out into the lines 11 in a metered manner. The control edge 58 of the control slide 2, together with a respective control opening 59, forms a respective metering valve 7, of which valves the two located in the plane of the drawing are shown, while the two others, not located in the plane of the drawing, are offset by 90° from the two metering valves shown. The actuation side of the control slide 2 may be engaged at an actuation end 60, for instance in a known manner by an air flow rate meter not shown, causing the displacement of the control slide 2 in accordance with the quantity of air aspirated by the engine. At the transition to the actuation end 60 having the smaller cross section, a step 61 is formed. The actuation end 60 is surrounded engagingly by a radial wall 62, thereby closing off the slide bore 56 at the bottom. An elastic sealing ring 63 is disposed at the radial wall 62, and in the position of rest of the control slide 2 the step 61 comes to rest against this sealing ring 63, thus sealing off the area from the outside. In the working position of the control slide 2, a leakage space 64 is formed between the step 61 and the radial wall 62, which intercepts the fuel leaking out of the control groove 57 over the outer circumference of the control slide 2 and communicates with a leakage line 65. The restoring force upon the control slide 2 counteracting the actuation force acting upon the control slide 2 is generated by fuel. To this end, the control slide 2 protrudes with an end face 70, which is embodied on the end of the control slide 2 remote from the actuation end 60, into a pressure chamber 69, which communicates via a damping throttle 68 with a line 71 branching off from the fuel supply line 3.

Figure 2:
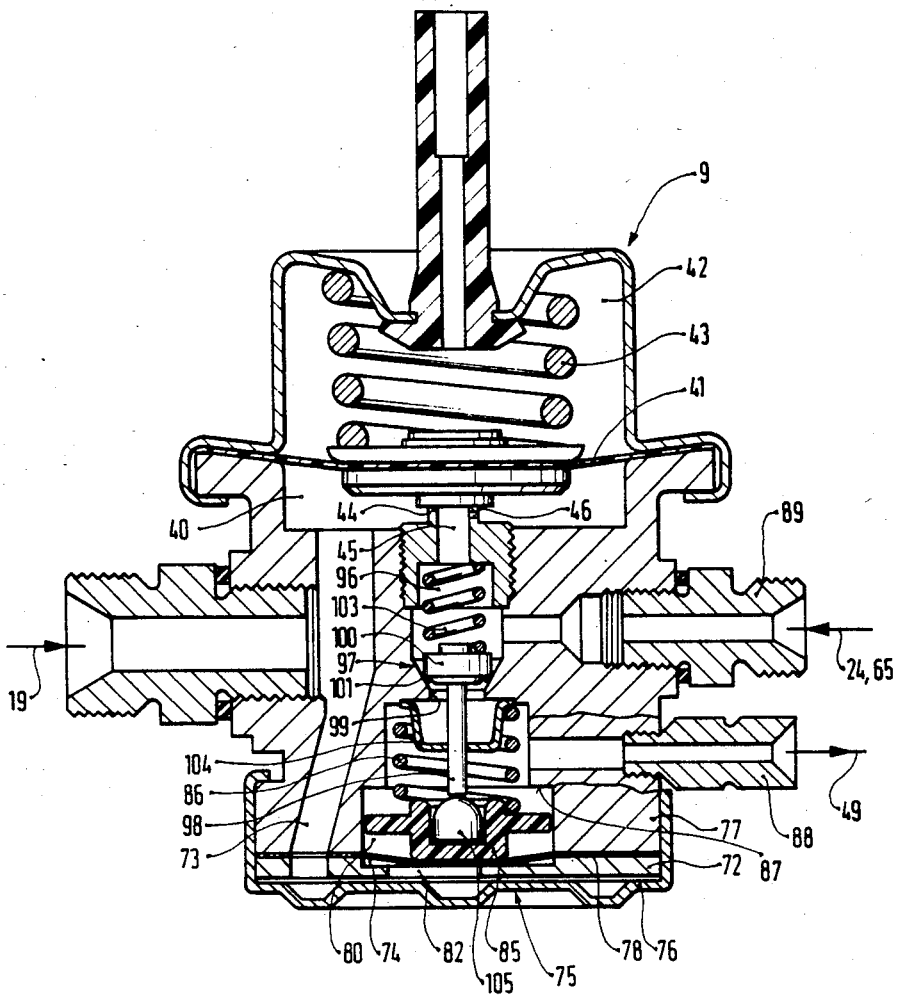
FIG. 2, shows on a larger scale, in cross section, a pressure limiting valve having a sealing valve.

Also communicating with the fuel supply line 3 is a switch line 73 leading to a switch chamber 74 of a switch member 75 (see FIG. 2 as well). The switch member 75 has a cap 76 and a member 77 with a resilient switch diaphragm 78 fastened in the periphery between the member 77 and an intermediate part 72 and dividing therefore the switch chamber 74 from a return flow chamber 80. Via a bore 82 of the intermediate part 72, the switch line 73 discharges into the switch chamber 74. A spring plate 85 on which a switch spring 86 is supported rests on the side of the switch diaphragm 78 oriented toward the return flow chamber 80. The movement of the switch diaphragm 78 into the return flow chamber 80 may be limited by providing that the spring plate 85 comes to rest with its periphery on a step 87 of the return flow chamber 80. Secured on the member 77 is a return flow fitting 88, shown offset in the drawing, by way of which the return flow line 49 communicates wtih the return flow chamber 80. The outflow line 24, which communicates via the control throttle 23 with the differential pressure control line 21, leads to an outflow fitting 89 on the member 77.

With further reference to FIG. 2 the outflow bore 45, like the outflow line 24, discharges into a collecting chamber 96, which is defined on the other end by a sealing valve 97. The sealing valve 97 has a tappet 98, which protrudes through a discharge opening 99 of the collecting chamber 96 into the return flow chamber 80 and is connected in the collecting chamber 96 to a sealing valve 100, which cooperates with a sealing valve seat 101 surrounding the discharge opening 99. A closing spring 103 disposed in the collecting chamber 96 is supported on the sealing valve element 100 and urges the sealing valve element 100 in the closing direction of the sealing valve 97. The tappet 98 is guided in the return flow chamber 80 by a guide body 104. The leakage line 65 may be connected to the collecting chamber 96 via the outflow line 24.

OPERATION

The function of the pressure limiting valve 9 having the switch member 75 and the sealing valve 97 is as follows: After the shutoff of the engine, the switch diaphragm 78 of the switch member 75 is displaced by the switch spring 86 and the closing spring 103 into a position in which it rests on the intermediate part 72. The sealing valve 97 is then in the closing position. If the engine is now started, then the fuel pump 5 pumps fuel out of the fuel container 6 into the fuel supply line 3 and thus, via the switch line 73, to the switch member 75 and into the system pressure chamber 40, causing the switch diaphragm 78 to be urged in the direction toward the return flow chamber 80. Once the fuel pressure attains a predetermined switch pressure, which is below the system pressure regulated by the pressure limiting valve 9, then the switch diaphragm 78 displaces the spring plate 85, which engages the tappet 98 via a rounded actuation member 105, and opens the sealing valve 97. The return flow lines 24, 45, 65 out of the fuel injection system are thus opened toward the fuel container 6. If the engine is now shut off, then the fuel supply by the fuel pump 5 is absent, and via the still-opened sealing valve 97 a rapid drop in the fuel pressure in the system takes place, to below the opening pressure of the injection valves 10, and at a closing pressure lower than the switch pressure the switch diaphragm 78 is seated on the intermediate part 72 and the sealing valve element 100 rests on the sealing valve seat 101, so that the sealing valve 97 closes all of the return flow lines 24, 45, 65 to the fuel container 6. The closing pressure of approximately 2.8 to 3.2 bar is below the opening pressure of the injection valves 10, by way of which, in a desired manner, no further fuel injection can take place, and is above the fuel vapor pressure at the associated fuel temperature, thereby avoiding vapor bubble formation in the fuel injection system which would impede or prevent restarting of the engine. A loss of volume and possible other leakage out of the fuel injection system can be compensated for over a relatively long period by means of the fuel stored in the spring reservoir 8.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection system for mixture-compressing internal combustion engines with externally supplied ignition, comprising fuel metering valves in a fuel supply line, said fuel metering valves having a movable metering valve element and a respective regulating valve associated with each said movable metering valve element, a movable regulating valve element arranged to receive varying pressures on different sides thereof, a pressure limiting valve located along said fuel supply line, said pressure limiting valve having a movable valve element which divides a spring chamber from a system pressure chamber arranged to communicate with said fuel supply line and a relief throttle, said system pressure chamber further including a valve seat with which said movable valve element cooperates, with said seat arranged to rest on an outflow line which communicates via a control throttle with a differential pressure control line, said differential pressure control line arranged to communicate with a sealing valve, said sealing valve including a valve seat and a sealing valve element said sealing valve element being urged in a closing direction toward said valve seat by a closing spring means, a tappet secured to said sealing valve element, said tappet extending downwardly into a return flow chamber in supporting engagement with an acutation member seated on a spring plate, a switch spring which forces said spring plate toward a switch diaphragm upon which said spring plate is seated, said switch diaphragm engages said sealing valve element remote from said outflow line, said switch diaphragm separates a switch chamber from said return flow chamber and is arranged to be acted upon on a side remote from said sealing valve element by said fuel pressure in said fuel supply line and said diaphragm further arranged to move counter to the force of said closing spring and said switch spring wherefore said sealing valve element is movable in the opening direction of said sealing valve, beyond a predetermined fuel pressure in said fuel supply line.

2. A fuel injection system as defined by claim 1, further wherein said relief throttle further includes means defining a notch in said valve seat of said pressure limiting valve.

* * * * *